United States Patent [19]

Baum et al.

[11] 4,051,701

[45] Oct. 4, 1977

[54] LEATHER SOFTENING MACHINES

[75] Inventors: Walter Baum, Frankfurt; Hans Helmut Brendel, Wehrheim, both of Germany

[73] Assignee: USM Corporation, Boston, Mass.

[21] Appl. No.: 743,753

[22] Filed: Nov. 22, 1976

[30] Foreign Application Priority Data

| | | |
|---|---|---|
| Dec. 2, 1975 | Germany | 2554175 |
| Dec. 2, 1975 | Germany | 7538410[U] |

[51] Int. Cl.[2] ..... C14B 1/40

[52] U.S. Cl. ..... 69/33

[58] Field of Search ..... 69/33, 34

[56] References Cited

U.S. PATENT DOCUMENTS

| | | | |
|---|---|---|---|
| 73,408 | 1/1868 | Tidd | 69/33 |
| 3,398,557 | 8/1968 | Dokoupil et al. | 69/33 |
| 3,677,041 | 7/1972 | Dokoupil | 69/33 |

FOREIGN PATENT DOCUMENTS

| | | | |
|---|---|---|---|
| 813,060 | 5/1969 | Canada | 69/33 |
| 859,991 | 1/1971 | Canada | 69/33 |
| 1,914,910 | 10/1970 | Germany | 69/33 |
| 1,914,964 | 3/1969 | Germany | 69/33 |
| 1,914,965 | 3/1969 | Germany | 69/33 |
| 43-5675 | 3/1968 | Japan | 69/33 |
| 1,448,355 | 9/1976 | United Kingdom | 69/33 |

*Primary Examiner*—Alfred R. Guest

*Attorney, Agent, or Firm*—Donald N. Halgren; Richard B. Megley; Vincent A. White

[57] ABSTRACT

A machine for processing flat, flexible articles, such as leather, to soften them. The machine utilizes a pair of opposed undulating surfaced processing members having an advance and return movement superimposed on an up and down movement. The opposed processing members are disposed on each side of the article to be processed, and soften the article, as well as move the article along between the processing members.

10 Claims, 8 Drawing Figures

LEATHER SOFTENING MACHINES

BACKGROUND OF THE INVENTION

1. Field of the Invention

This invention relates to a machine for the processing of flat flexible articles, and more particularly, to a machine for the softening of leather.

2. Prior Art

Leather softening machinery is described in U.S. Pat. No. 3,398,557 and in German Patent AS No. 1,285,092. The machine defined in the U.S. Pat. No. 3,398,557 requires that the workpiece be fed through processing members by a person tending the machine.

The German Patent AS No. 1,285,092 describes a device for the softening of leather, wherein the leather is conveyed continually between two flexible conveyer belts along a processing-gap between a pair of processing members. On this device, the conveyer belts, by the constant bending that extends in alternating directions over the whole area of the conveyer belts, are subjected to considerable strains which lead to a rapid wearing-out of the belts.

On the known machines for the softening of leather, especially those as described in the U.S. Pat. No. 3,398,557, and the German AS No. 1,285,092, an exclusively linear up-and-down movement is provided in at least one processing member. In the case of the movement of both processing members, these execute the up-and-down movement in opposite direction from time to time. The principle requires an additional feed-arrangement which is comprised of either the person tending the machine or by some conveyer belts.

SUMMARY OF THE INVENTION

The present invention comprises a leather softening machine which includes a pair of processing members that combine an advance-and-return movement with an up-and-down movement to effect an advance to the leather as well as a softening thereof. The invention therefore, leads to an automation of workpiece feed in a leather softening machine, eliminating the use of any conveyor belts which would be subject to extensive wear and tear.

According to the invention, both processing members operate in a closed position and an open position. In the closed position, the working portions of each of the processing members contact the workpiece to soften it and give it a thrust movement as well. In the open position, the processing members release the workpiece, and they then execute a return movement. Both of the movements are superimposed on one another due to an arrangement wherein each processing member is mounted on a rotating cylindrical arm. Both rotating cylindrical cams are provided with synchronized drives. The movement of each processing member contains components of up-and-down movement and components of advance-and-return movement because each rotating cylindrical cam imparts a generally elliptical closed ring movement therewith. The processing members are disposed generally parallel with one another and maintain that general relationship during the operation of the machine. Each processing member is provided with an arm directing its path from its cam mounting; and a lever, arranged at an angle thereto and rotatably articulated therewith, pivotally secured on its side remote from the arm to a stationary portion of the machine, to help maintain that generally parallel relationship between the processing members.

The machine works without conveyer belts, therefore, it is possible to select a relatively high frequency for the periodic movement of the processing members, such as would otherwise quickly lead to the destruction of any conveyer belts. Leather softening machines with conveyer belts work at a frequency of approximately 10 cycles per second. The device according to the invention can be driven at 20 cycles per second, leading to a doubling of work intensity. This doubling permits the shortening of the length of the proccessing members, and a corresponding reduction in their mass. With smaller processing members and correspondingly smaller mass, a correspondingly lighter frame construction and lower powered drive is permitted. A reduction in the size of the processing members permits a reduction in the forces brought to bear upon them, which permits a considerably smaller loading of the machine construction.

BRIEF DESCRIPTION OF THE DRAWINGS

The objects and advantages of the present invention will become more apparent when viewed in conjunction with the following drawings in which.

DETAILED DESCRIPTION OF THE PREFERRED EMBODIMENTS

Figure 1:
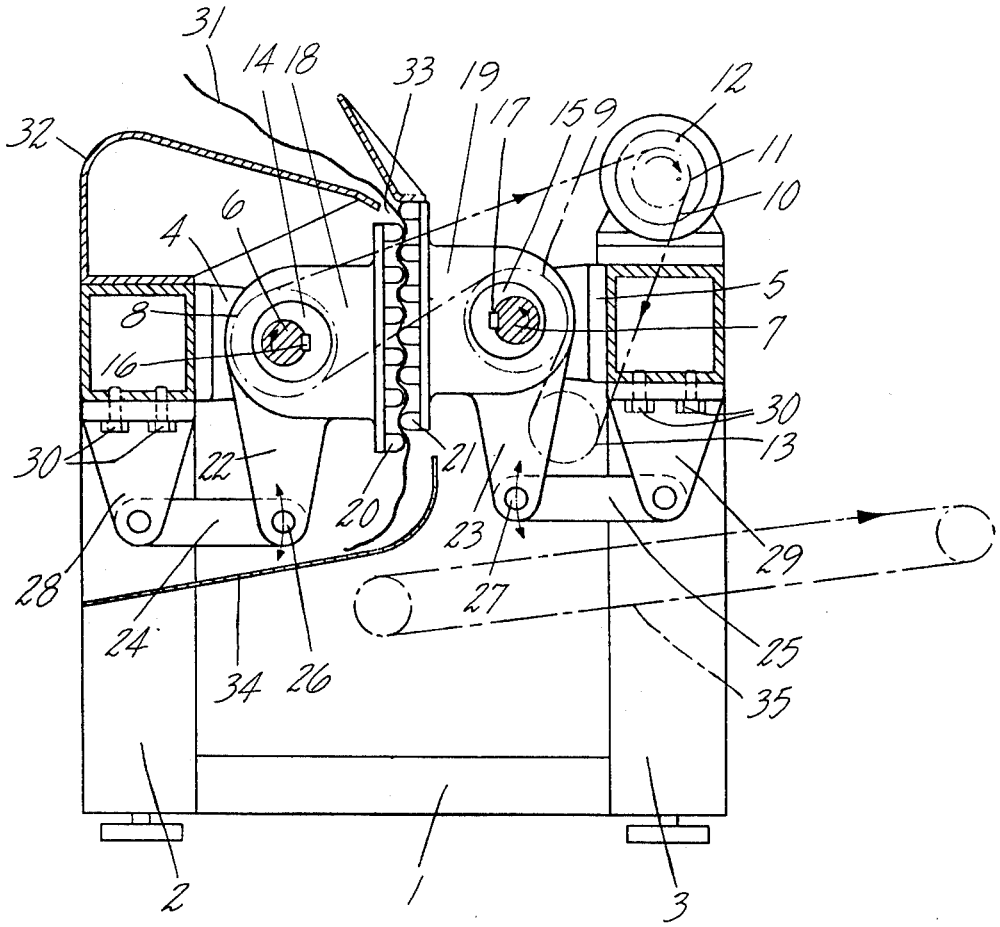
FIG. 1 is a section of the device viewed from the side, with processing gap arranged vertically.

Referring to the drawings in detail, and more particularly to FIG. 1, there is shown a device which consists of a frame 1, which has mounted thereon, a pair of supports 2 and 3, an arrangement of bearers, 4 and 5, for a pair of driving shafts, 6 and 7, respectively. The driving shafts, 6 and 7, are seated at the rear of the device. Each driving shaft, 6 and 7, has a chain-wheel 8 and 9, around which is wound a drive-chain 10. The drive chain 10 also runs over a drive chain wheel 11 of a motor 12 and a guide sprocket 13, whereby a corresponding looping around the chain wheels, 8 and 9, ensures that the drive shafts 6 and 7 rotate in opposite directions. The drive chain 10 moves in accordance with the arrows shown in FIG. 1. The direction of rotation of the drive shafts, 6 and 7, is also indicated by arrows.

The drive shafts, 6 and 7, have a pair of operating cams, 14 and 15, disposed therearound. The cams, 14 and 15, are secured against rotation in relation to the drive shafts, 6 and 7, by an arrangement of key wedges, 16 and 17. The operating cams, 14 and 15, rotate in corresponding bearings, each in a processing member, 18 and 19, and these can be either slide bearings or roller bearings. The bearings are not shown in detail in FIG. 1.

Figure 6:
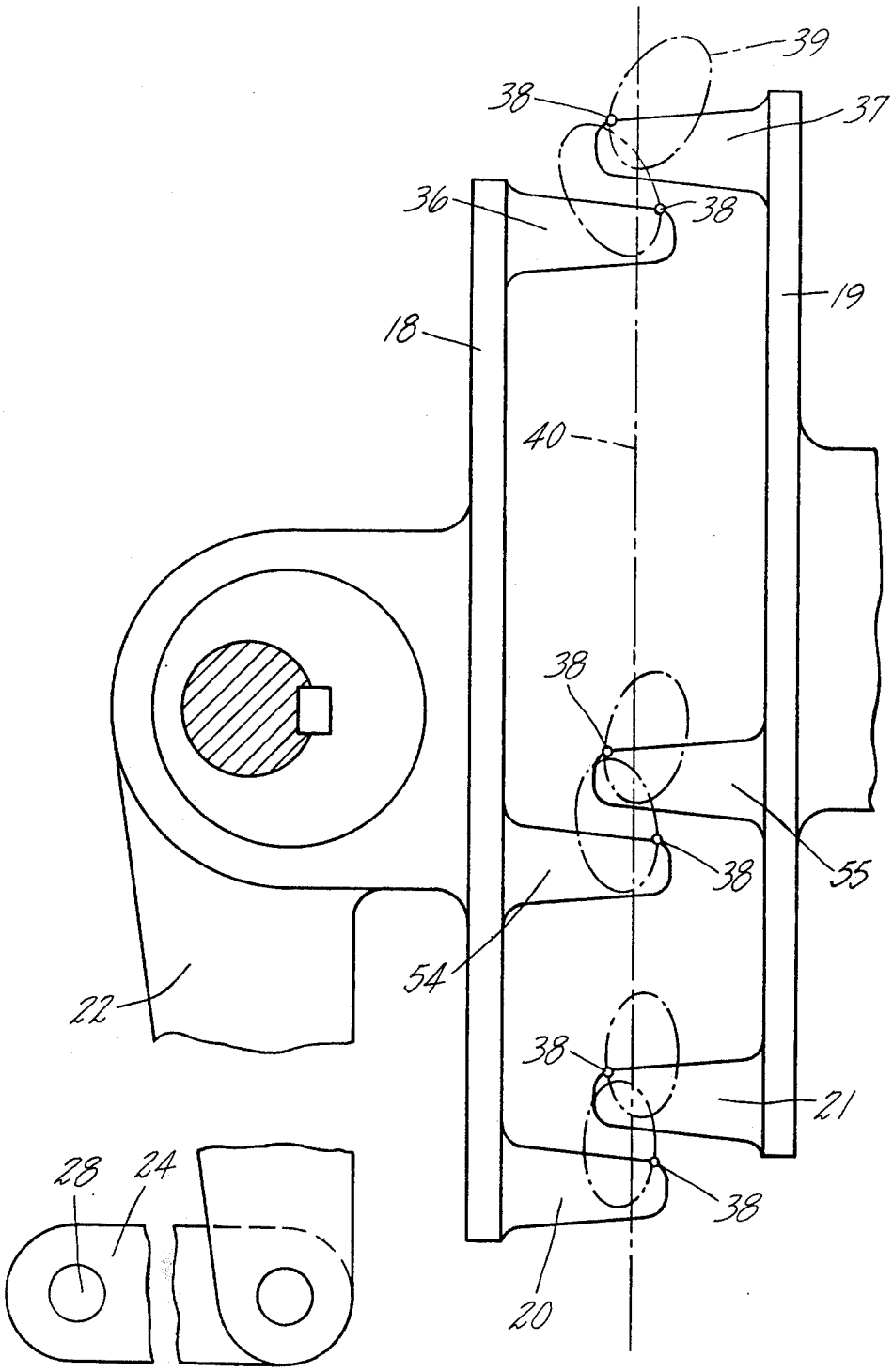
FIG. 6 is a diagrammatic representation of the movement paths of single projections of the processing members of a device according to FIG. 1.

With the rotation of the drive shafts, 6 and 7, the processing members, 18 and 19, execute according to the function of the cams 14 and 15, both a to-and-fro movement in the direction towards and away from each other, besides moving up and down in the sense of an advance-and-return movement. These two directions of movement naturally superimpose themselves upon each other. The inner side of the processing members, 18 and 19, have an arrangement of projections, 20 and 21, facing each other, as shown in FIG. 6. The processing members, 18 and 19, are held substantially parallel to each other. An arm, 22 or 23, directed from each cam-mounting and a link, 24 or 25, arranged at an angle thereto, permits the general parallelism between the processing members, 18 and 19. Each link, 24 or 25, is rotatably articulated to its respective arm, 22 or 23, through a lug, 26 or 27. The link, 24 or 25, ends with its end remote from the arm, 22 or 23, in a pivot-bearing, 28 or 29. The pivot-bearing, 28 or 29, is fitted rigidly, but subsequently adjustable, to the support, 2 or 3. Details will be given below about the effects of an adjustment of the pivot-bearing, 28 and 29. The adjustability is permitted because the pivot-bearing, 28 and 29, is secured through an arrangement of bolts 30, to the support, 2 and 3. The pivot-bearings, 28 and 29, can be either raised or lowered in respect to the position of their point of rotation after the bolts 30, are loosened, permitting changing spacers.

Before the cycle of movement of the processing members, 18 and 19, is discussed in more detail, it might be first explained how the workpiece, in this case, leather, is fed through the device. The leather, 31, may be fed through the machine in either direction depending upon the orientation of the particular camming elements and the like. A 180° turn of these elements would permit the leather, 31, to be fed through the machine in the direction opposite that described below. As shown in FIG. 1, a piece of leather, 31 is guided from above over the feed table, 32 into a processing gap 33, here shown in vertical arrangement, between the processing members, 18 and 19, until it issues from their outlet end. Here it is received by a chute 34 and is passed on. Instead of the chute 34, a conveyer belt 35, shown in broken lines, may also be provided to carry off the processed leather.

The movement of the processing members, 18 and 19, resulting from their special mounting, is now explained by reference to FIGS. 2 to 5, which show only those construction components presented to aid the understanding of the cycle of movement.

Figures 2, 3, 4, 5:
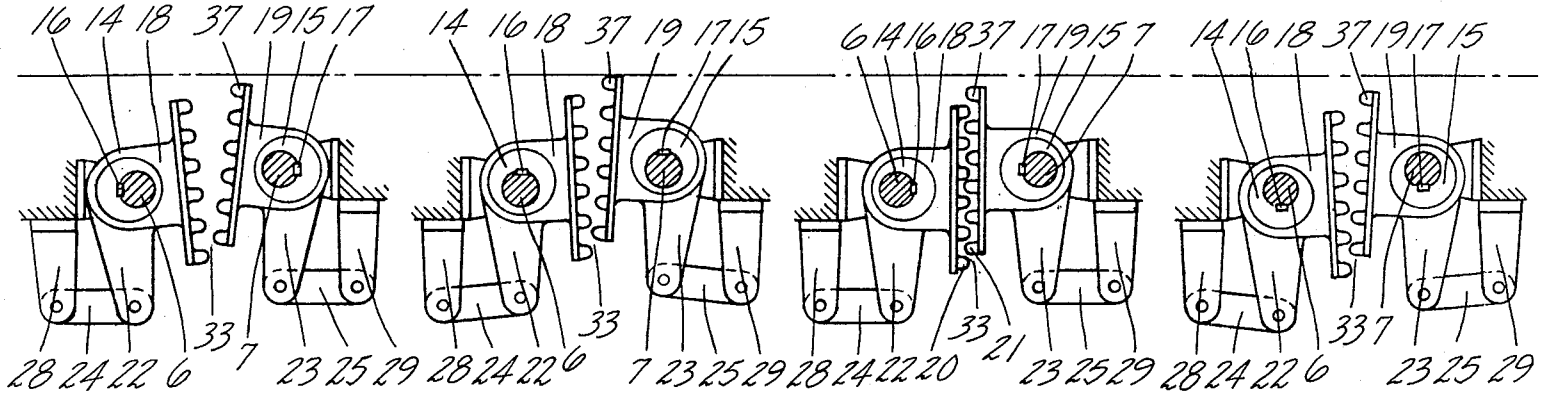
FIGS. 2 through 5 are views of the processing members of the device according to FIG. 1 in four successive working cycles.

In FIG. 2 the open position of the processing members, 18 and 19, is shown, in which the working cams, 14 and 15, by their corresponding position, have brought the processing members, 18 and 19, into the engine position of withdrawal from each other. In this position, the key wedges, 16 and 17, are pointing away from the processing gap 33. The latter is thereby opened upwards in a slight wedge-shape, so that in this position the leather can easily be guided into the processing gap 33 from above.

FIG. 3 shows the next operating phase in which the drive shafts, 6 and 7, and with them the working cams, 14 and 15, are rotated about 90° into a position in which the key wedges, 16 and 17, have moved upward. With this rotation of the working cams, 14 and 15, the processing members, 18 and 19, execute a substantially upwards movement as return movement and a forward movement in the direction of the other processing member, whereby the respective levers, 24 and 25, and pivot-bearings, 28 and 29, are displaced slightly upwards. The arms, 22 and 23, thereby execute a slight outwardly directed pivoting movement, whereby the processing gap approaches more the parallel position of the processing members, 18 and 19.

In FIG. 4 the operating phase is represented, in which the drive shafts, 6 and 7, have rotated about a further quarter revolution, and together with the working cams, 14 and 15, are thereby pointing in the direction of the processing gap 33. In this position, the working cams, 14 and 15, have pushed the processing members, 18 and 19, into their foremost position, in which the projections, 20 and 21, are thus most deeply engaged in each other. The processing members, 18 and 19, are also parallel to each other.

The following operating position, represented in FIG. 5, shows the drive shafts, 6 and 7, together with the working cams, 14 and 15, rotated about a further quarter revolution in which the key wedges, 16 and 17, are pointing downwards. In this position, the processing members, 18 and 19, are again moved a certain distance away from each other, owing to the effect of the cam. They are also displaced downwards, whereby the processing gap 33 between the processing members is again opened in a slight wedge-shape. In the movements of the processing members, 18 and 19, from the operating phase represented in FIG. 3 to the operating phase according to FIG. 5, the levers, 24 and 25, execute a pivoting movement downwards, as the processing members, 18 and 19, are moved downwards by the cams, 14 and 15. In this pivoting of the levers, 24 and 25, the arms, 22 and 23, rotate outwards relatively to the working cams, 14 and 15, so that the parallel position of the processing members, 18 and 19, as shown in FIG. 4, occurs. If the processing members, 18 and 19, are displaced further downwards by further rotation of the working cams, 14 and 15, and again drawn apart from each other, the levers, 24 and 25, likewise swing downwardly but exert a certain amount of pressure on the arms, 22 and 23, by the separating action of the processing members 18 and 19, so that the arms, 22 and 23, are swung inwardly which permits the slight wedge-shape of the processing gap 33, as represented in FIG. 5.

In FIG. 6 there is illustrated the sequences of movement of the projections, 20 and 21, a second pair of projections, 54 and 55, and also a third pair of projections, 36 and 37. The projections, 36 and 37, are situated at the entry end of the processing members, 18 and 19. The ellipses depicted in connection with a projection represent the path of movement of a specified point on the relevant projection. Thus the projection 37 describes an ellipse 39 made by a point 38 thereon. A corresponding statement applies for the other projections, 36, 54, 20 and 21. FIG. 6 plainly shows that the ellipses, from above downwards in the pass-through direction, progressively conform more and more to the vertical with their longest axes, and increasingly overlap a middle demarcation line 40. The overlapping of the middle line 40 by the ellipses indicates that the processing members engage in each other to a corresponding depth and length. It can also be seen from FIG. 6 that the section of ellipse overlapping in each case the middle line 40 increased from above downwards. This signifies that the workpiece is processed for a correspondingly increasing duration by the relevant projections. This promotes an increase in processing intensity in the pass-through direction.

Figure 7:
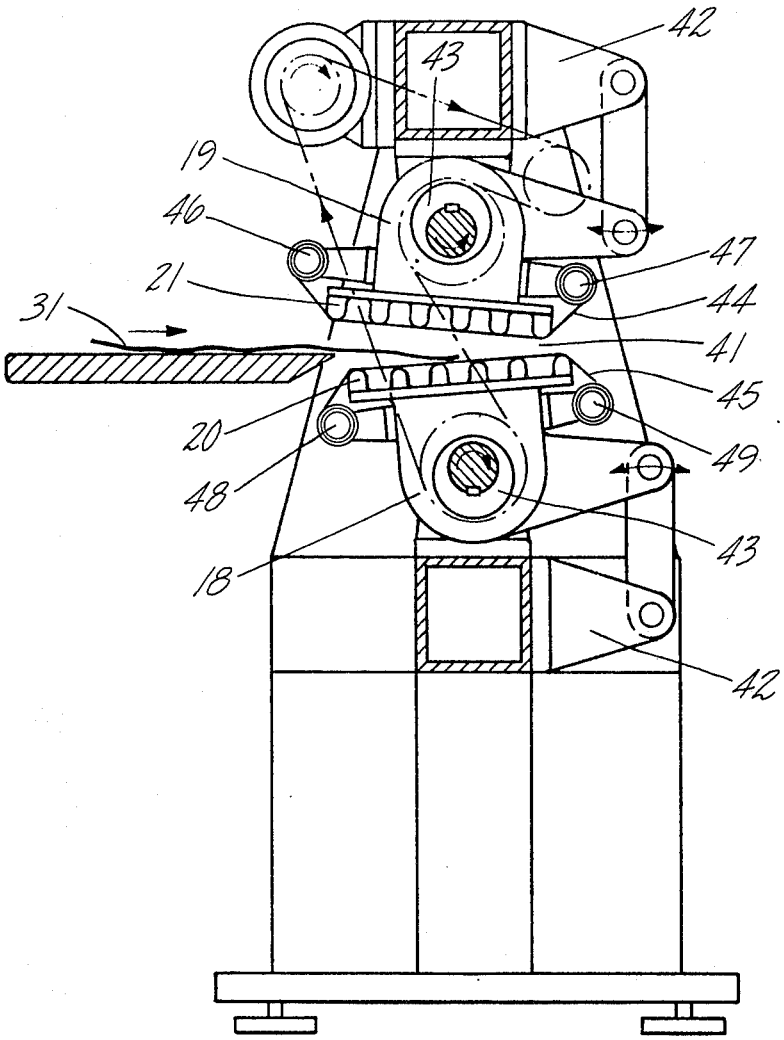
FIG. 7 is a device with a horizontally arranged processing gap.

The device depicted in FIG. 7 exhibits a horizontally situated processing gap, 41. Otherwise the device works like that shown in FIG. 1, and the explanations according to FIGS. 2 to 6 apply as well. Analogously to the arrangement of the pivot bearings, 28 and 29, as shown in FIG. 1, on the device according to FIG. 7, a pair of pivot bearings 42, are arranged with a pair of working cams 43, in the forward feed direction, this direction being indicated by arrow pointing towards the processing gap, 41. This arrangement of the pivot bearings 42 permits the desired effect in that the entry side of the processing gap 41 opens wider than on the outlet side.

A pair of flexible covers, 44 and 45, are stretched over the projections, 20 and 21, of processing members, 18 and 19, to prevent the projections, 20 and 21, from forming an obstacle for the edge of the workpiece when the latter is being inserted into the processing gap 41. The covers, 44 and 45, may be comprised of for example, an elastic foil. The covers, 44 and 45, stretch in such a way over the projections, 20 and 21, that they present substantially flat surfaces so that the workpiece (here, the leather 31) can be pushed without hindrance into the processing gap 41 as the processing members, 18 and 19, are drawn apart, out of engagement with each other. The covers, 44 and 45, end on both sides of the processing members, 18 and 19, each in an upper roller, 46 and 47, respectively, and also in a pair of lower rollers, 48 and 49, respectively. The covers, 44 and 45, are held stationary during the operating of the device. If a cover becomes damaged during machine operation, the machine operator needs only to wind it from one roller on to the other until a complete, undamaged section of the cover stretches over the relevant processing member. In this, practically no interruption of the operating of the device is required.

Figure 8:
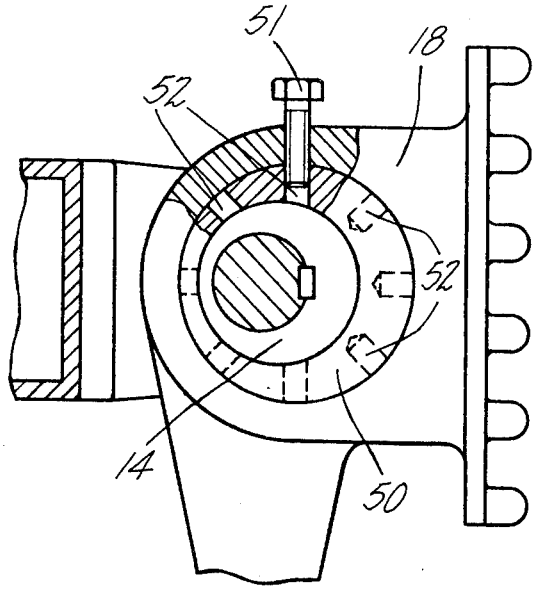
FIG. 8 is a view of an adjusting cam which permits selectable adjustment of the processing depth.

A selectable adjustment of the processing depth of the processing members is made possible by utilization of an adjustable cam 50, which comprises the axis portion of the processing member, 18, as depicted in FIG. 8. In practical terms, the adjustable cam, 50, represents the outer bearing for the working cam 14. By the rotation of the adjustable cam 50, the working cam, 14, assumes a specific position relative to the processing member 18. This position being determined by the amount of rotation of the adjustable cam 50. The adjustable cam 50 is held in fixed relation to the processing member 18 by an adjusting screw 51. A number of borings, 52, are provided for the different adjustments of the adjustable cam, 50. In the position depicted of the adjustable cam, 50, the latter has moved the processing member 18, in the direction of the greatest depth of engagement.

It can be seen from FIGS. 2 to 5 that the processing members, 18 and 19, continually travel downwards, in relation to a broken reference line extending above the Figures, out of the position shown in FIG. 3 to the one in FIG. 5. The broken reference line represents a distance from the frame 1 of the device, which remains constant. The increasing distance of the entry side of the processing members, 18 and 19, on the way through the working phases according to FIGS. 3 to 5, shows that over these processing phases a piece of leather held by the processing members, 18 and 19, is carried downwardly with it. A forward feed movement is thus imparted to the leather. When the processing phase, as shown in FIG. 5, commences, the processing members, 18 and 19, again move away from each other and execute the return movement which consists of the path through the processing phases according to FIGS. 5, 2 and 3. The leather then remains, relative to frame 1 of the machine, in substantially the position that it has reached, since it is prevented by its own inertia from participating in the return movement. Moreover, according to the law of inertia, it actually tends to follow its previously enforced forward feed movement. In addition, there is also the force of gravity which helps the further downward movement of the leather.

Applying these considerations to the device, as shown in FIG. 7, the same forward feed effect occurs. The leather is pushed in the direction of the arrow during the coming together of the processing members, 18 and 19, until it is again released from them. They then execute the return movement, as described above. By reason of its inertia, the leather does not participate in this return movement. This effect is further supported here by the covers, 44 and 45, stretched over the projections, 20 and 21, as the smooth surface of the covers does not give rise to any significant friction upon the leather on the return movement of the processing members, 18 and 19. There also occurs, with the horizontal processing gap, 41, as shown in FIG. 7, an automatic foward feed effect without any need of conveyer belts. The forward feed effect is caused solely by the movement of the processing members, 18 and 19, which execute not only an up-and-down movement but also a to-and-fro movement.

Having thus described my invention what I claim as new and desire to secure by Letters Patent of the United States is:

1. A machine for the processing of flat, flexible workpieces by means of two opposing processing members, between which the workpieces are guided through, and whose distance apart is periodically increased and decreased by a relative movement, whereby the workpieces intended for processing is pressed by an arrangement of projections fitted on at least one processing member into an arrangement of corresponding recesses on the other processing member, wherein both processing members execute a feed movement in the closed position, taking the workpiece with it, and in an opened position, by contrast, the processing members execute a return movement.

2. A machine as recited in claim 1, wherein each processing member is mounted on a rotating working cam and each cam is provided with a mutually enforced drive.

3. A machine as recited in claim 2, wherein each of said working cams are provided with a common drive.

4. A machine as recited in claim 3, wherein said working cams are provided with a pair of drive wheels of equal size, over which is guided a drive belt.

5. A machine as recited in claim 4, wherein each processing member is provided with an arm extending from its cam mounting and a lever is rotatably articulated to said arm, which on its side remote from the arm ends in a pivot bearing that remains anchored while the machine is running.

6. A machine as recited in claim 5, wherein said pviot bearing is fitted so as to be capable of adjustment for the purpose of modifying the path of the processing members.

7. A machine as recited in claim 6, wherein said working cam is mounted in an adjusting cam to give selectable adjustment of the processing depth.

8. A machine as recited in claim 7, wherein at least one of the processing members has an elastic cover stretched over it.

9. A machine as recited in claim 8, having a processing gap between the processing members which is substantially horizontal.

10. A machine as recited in claim 8, having a processing gap between the processing members which is substantially vertical.

* * * * *